United States Patent [19]

Niebylski et al.

[11] 3,940,262

[45] Feb. 24, 1976

[54] REINFORCED FOAMED METAL

[75] Inventors: Leonard M. Niebylski, Birmingham; Chester P. Jarema, Detroit, both of Mich.; Thomas E. Lee, Baton Rouge, La.

[73] Assignee: Ethyl Corporation, Richmond, Va.

[22] Filed: Feb. 22, 1974

[21] Appl. No.: 444,823

Related U.S. Application Data

[63] Continuation-in-part of Ser. No. 235,294, March 16, 1972, abandoned, which is a continuation-in-part of Ser. No. 155,342, June 21, 1971, abandoned.

[52] U.S. Cl. ..... 75/20 F; 29/180 R; 75/138

[51] Int. Cl.[2] ..... C21B 5/02; B22D 27/00

[58] Field of Search ..... 75/20 F, 20 R, 138; 29/180 R, 183

[56] References Cited

UNITED STATES PATENTS

| | | | |
|---|---|---|---|
| 2,937,938 | 5/1960 | Fiedler | 75/20 F |
| 3,047,383 | 7/1962 | Slayter | 75/20 F |
| 3,214,265 | 10/1965 | Fiedler | 75/20 F |
| 3,300,296 | 1/1967 | Hardy et al. | 75/20 F |
| 3,692,513 | 9/1972 | Hall | 75/20 F |
| 3,705,030 | 12/1972 | Berry et al. | 75/20 F |
| 3,707,367 | 12/1972 | Bsorksten et al. | 75/20 F |

*Primary Examiner*—Walter R. Satterfield

*Attorney, Agent, or Firm*—Donald L. Johnson; John F. Sieberth; James M. Pelton

[57] ABSTRACT

Foamed metal articles having reinforcing fibers, such as inorganic fibers; for example, fiberglass, refractory fibers, and metal fibers, dispersed in the foamed metal for strength improvement. Processes of manufacturing such fiber reinforced foamed metal articles are also disclosed.

14 Claims, 1 Drawing Figure

REINFORCED FOAMED METAL

CROSS REFERENCE TO RELATED APPLICATION

This application is a Continuation-in-Part of application Ser. No. 235,294, filed Mar. 16, 1972, now abandoned which in turn is a Continuation-in-Part of application Ser. No. 155,342, filed June 21, 1971, now abandoned.

BACKGROUND OF THE INVENTION

Foamed metal articles are relatively new. Only very recently have the problems of uniform density and foam reproducibility been solved. Uniformity and reproducibility are required for commercial acceptance and production. This invention contributes significantly to increasing the strength-to-weight ratios of the metal foams produced. The foamed metal articles produced have generally higher strength-to-weight ratios than foamed metal articles heretofore produced.

Foamed metals have been described previously; see for example, U.S. Pat. Nos. 2,895,819; 3,300,296; 3,297,431. In general such foams are produced by adding a gas-evolving compound to a molten metal and heating the mixture to decompose the compound causing the gas evolved to expand and foam the molten metal. After foaming, the resulting body is cooled to solidify the foamed mass forming a foamed metal solid. The gas-forming solid can be metal hydride; such as, titanium hydride, zirconium hydride, or lithium hydride (such as described in U.S. Pat. Nos. 2,983,597); or in general any metal hydride which evolves hydrogen on decomposition.

Fiber reinforced foams have also been described; see U.S. Pat. Nos. 3,707,367 and U.S. 3,773,098. However, processes described require unusual low speed mixers or expensive baffled tube mixers which are slow and expensive processes. In contrast and complete contradiction to the prior art, applicants have employed high speed mixing equipment for short times to produce fiber reinforced foamed metals with acceptable uniformity, reproducibility and increased strength.

SUMMARY OF THE INVENTION

A process for producing a fiber reinforced metal foam, said process comprising dispersing with high speed stirring from about 0.1 to about 25 weight percent, based on the weight of said metal foam, of fibers from about 125 to about 1000 mils in length into a molten metal to be foamed, foaming the molten metal, and cooling the foamed metal to set said foam. In another preferred aspect of this invention, the fiber may be an inorganic fiber selected from the group consisting of fiberglass, metallized fiberglass, mineral fibers, refractory fibers and metal fibers.

DESCRIPTION OF PREFERRED EMBODIMENTS

Figure 1:
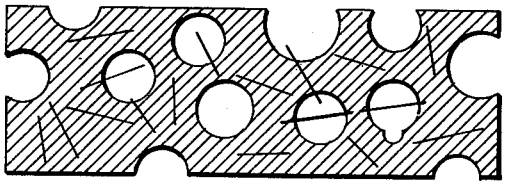
FIG. 1 which is not to scale illustrates the foamed article produced by the process of this invention.

Reinforcing of metal foams requires a material which is not deleterious to the metal, has considerable strength but low density and weight, and which is easily adapted to processes for producing metal foams. The material must adhere strongly to the metal since a considerable volume of foamed metals consists of the void spaces encompassed by the cells of the foam. The fiber can, in general, be any fiber which can be incorporated into a foamed metal body. For example, materials which are wetted by the metal are illustrative of this invention. In a preferred embodiment the fibers are inorganic fibers. More preferred are inorganic fibers selected from the group consisting of fiberglass, metallized fiberglass, mineral fibers, refractory fibers and metal fibers.

Another class of materials suitable as reinforcing fibers are the tough, high strength, heat resistant organic fibers, such as polyamide fibers commercially available from DuPont under the tradename "Nomex," or polybenzimidazole fibers and the like. Also, organic fibers which are heat resistant and have chemically inert or physical abrasion resistant coatings are suitable.

The reinforcing fiber may be in any form which is convenient for incorporation into the foamed metal body, that is, it may be in long continuous strands, filaments or fibers which are long enough to span a number of cells in the foamed metal body as shown in FIG. 1. Preferably, the fibers range from about 125 to about 1000 mils in length, with fiber lengths of from about 125 to about 625 mils being more preferred. Fiber diameter is not critical, and commercially available fibers are suitable, so long as the fibers have a high ratio of length to diameter, that is, greater than 50. The above lengths are the lengths of fibers initially incorporated into the foamed metal. During dispersion, some fibers are broken but a substantial amount remains within the preferred range.

The amount of fiber included in the foamed metal body is not critical so long as sufficient fiber is included to reinforce the foam metal. Thus, the amount of fiber included may vary depending on the foamed metal substrate. Low strength foams will show a remarkable increase in strength with relatively low amounts of fiber material included therein, for example, from about 0.1 percent by weight or more. On the other hand, higher strength foams, whether using higher strength alloys or higher density foams, may require more reinforcing fiber to show significant strength improvements; that is, about 1 weight percent or more. The amount of reinforcing fiber should not be so large that other advantageous properties of foamed metals are affected.

In general, the amount of reinforcing fiber can range from about 0.1 to about 25 weight percent based on the total weight of the foamed metal article. Preferably, for aluminum-based foams, amounts of reinforcing fiber from about 1 to about 25 weight percent based on the weight of the foam may be used. More preferably, the aluminum-based foams can contain from about 5 to about 15 weight percent when the fiber is either fiberglass or aluminized fiberglass. For zinc-based foams it is preferred to employ from about 0.1 to about 10 weight percent of reinforcing fiber to obtain significant increase in strength. More preferably, from about 0.2 to about 5 weight percent based on the zinc foam of reinforcing fiber is used when the fiber is fiberglass or aluminized fiberglass.

One of the preferred types of fibers is fiberglass. This material is well known and has been used in the past as a reinforcing material; for example, in plastics. The type of fiberglass used is not critical. However, it has been found that the random dispersion of chopped fibers produces a foamed metal body of good strength without sacrificing the relatively low weight of the foamed metal. A preferred type of fiberglass is fiberglass which has been coated or metallized with a metal. The nature of the metal is not critical but is used to improve the compatibility of the fiberglass with the foamed metal body. Without limiting the invention, it is a preferred embodiment of this invention to incorporate a metallized fiberglass into the foamed metal. A suitable metal-coated fiber is one which has been coated with a metal selected from the group consisting of aluminum, zinc, lead, nickel, magnesium, copper, and alloys of these metals. More preferred are aluminum, zinc, and nickel for coating materials. It is immaterial as to the method by which the fiberglass is metallized. However, a convenient process is to flame-spray or vacuum-sputter the fiberglass with the coating metal. Commercial processes include simply drawing the fiber through the molten metal as, for example, in the case of aluminum or zinc coatings, or by electroless plating, such as for nickel coating. When the metal coating for fiberglass is the same as the metal used in the foamed metal body, a most compatible metallized fiber will be provided. Thus, a most preferred embodiment of this invention is aluminum-coated fiberglass and zinc-coated fiberglass.

The coating of fiberglass with a metal is a non-limiting example of metal coated fiber. Any of the fibers useful in this invention may be metal coated. Metallized fibers can be advantageously incorporated into the metal foam. The metal coating of the fiber can be the same or different from the metal of the foam. Any of the metals described above for metallizing fiberglass can be used for the mineral, refractory, or metal fibers disclosed below.

The refractory fibers which are useful in this invention are made from any refractory material prepared in fiber form. By refractory is meant a material which has a high melting point and is resistant to the action of heat. A preferred group of refractory materials which may be used as refractory fibers for reinforcing foamed metal are selected from the group consisting of potassium titanate, silicon carbide, boron nitride, titanium carbide, titanium dioxide, carbon, graphite, alumina, silica, alumina-silica and the like. As with the case of fiberglass, such refractory fibers are more compatible with the foamed metal body and can be more easily incorporated therein when coated with a metal. Thus, preferred refractory fibers are the foregoing when coated with metal. Appropriate metals for coating refractory fibers are disclosed hereinabove. Most preferred refractory fibers are potassium titanate, boron nitride, graphite, alumina, alumina-silica, and such fibers coated with metal. Particularly, aluminum-coated graphite and potassium titanate are preferred.

Other inorganic fibers suitable for reinforcing foamed metal bodies are mineral fibers which are not necessarily considered to be refractory. Examples of such materials are asbestos, kaolin, alumina-silica, alumina-magnesia, and alumina-magnesia-silica fibers. It should be recognized that any known inorganic material which is found in nature or which may be produced by inorganic reactions, which is not found in any particular classification above and which is capable of being made into a fiber may be suitable mineral fiber within the scope of this invention.

Metal fibers are a further preferred type of reinforcing fiber. Fibers produced from iron, steel, nickel, titanium, copper, magnesium and the like are preferred metal fibers. Also preferred are alloys of these metals. Further, the metal-plated metal fibers are useful in this invention. For example, nickel-plated iron, nickel-plated steel, nickel-plated copper, aluminum-plated steel and the like are preferred metal-plated and metal fibers. It is, of course, unnecessary that the pure metals be employed because alloys of any of the foregoing metals which are available commercially may be used.

The foamed metal body in which the foregoing fibers are incorporated may be produced from any suitable metal which is capable of being foamed. Thus, aluminum, steel, zinc, lead, nickel, magnesium, copper and alloys thereof are preferred metals for producing metal foams. The metal foams produced in the prior art processes are generally suitable as metal foams according to this invention. It is inappropriate here to include a vast amount of description regarding the production of metal foams. Reference has been made to several prior art processes for producing metal foams. Such processes as in U.S. Pat. Nos. 2,895,819; 3,300,296 and 3,297,431 are useful and are hereby incorporated by reference. To produce fiber-reinforced foamed metal, the foregoing processes only require the inclusion of reinforcing inorganic fibers. Such inclusion can employ high speed stirring of fibers into the molten metal at any appropriate point in the process.

In addition to modifying the prior art processes, reinforced foamed metal articles can be prepared by a proceess comprising increasing the viscosity of a molten metal by incorporating therein a viscosity-increasing agent selected from the group consisting of air, carbon dioxide, nitrogen, oxygen, water, and the inert gases into said molten metal and then dispersing said inorganic fiber into the thickened molten metal, foaming the molten metal and then cooling the foaming molten metal to set the foam, thus producing a reinforced foamed metal article.

Accordingly, this invention provides a method for producing an aluminum-based foam which comprises (a) increasing the viscosity of a molten aluminum-based metal with a viscosity-increasing amount of a viscosity-increasing agent, said viscosity increasing agent being admixed with the molten aluminum alloy at a temperature of from about 20° to about 90°C above the liquidous point of the said molten aluminum alloy, and (b) treating the viscous melt thereby produced. In this operation, the thickened system is heated sufficiently to thermally decompose the blowing agent to release gas which makes the foaming take place.

Upon cooling, a set foam is produced. Such foams produced by this invention are characterized by a surprising degree of uniformity in pore size and configuration. They can be used as structural materials especially where it is advantageous to have a light metal construction; for example, in trailer walls, doors and floors, aircraft decking, sandwich wall constructions, curtain walls, etc.

Ordinarily molten aluminum and its alloys have viscosities akin to water. When such metals are treated with a viscosity-increasing agent in accordance with this invention, a much thicker melt can be produced. Generally speaking, the thickness is proportional to the amount of agent added. In fact, it is possible to make a material so thick that it is stirred with difficulty by powerful stirring devices.

Viscosity, as the term is used herein, refers to fluidity of a liquid. (In a technical sense, fluidity is the reciprocal of viscosity or "apparent" viscosity.) A liquid will flow slowly (have less fluidity) when the viscosity is increased. There are two types of viscosity, true viscosity and apparent viscosity. Apparent viscosity refers to the viscosity equivalence in appearance and mobility of a fluid which when measured with a viscometer evidences no or only a slight change in true viscosity. An example of a material exhibiting apparent viscosity is whipped cream. It is not known whether the viscosity-increasing treatment of this invention results in an increase of true and/or apparent viscosity. Nevertheless, the above viscosity-increasing agents, for example, can change an aluminum-based metal from a material having about the same resistance to flow as water, to one much less fluid. It appears that the increase in viscosity is a major increase in apparent viscosity and a minor increase in true viscosity. It has been found that treatment of an aluminum alloy having 7 percent magnesium with a viscosity-increasing agent increased the viscosity (according to viscosity measurement) only about 16 centipoises. Nevertheless, when such a molten alloy is treated, according to this invention it is possible to prepare a viscous melt very resistant to pouring out of a spoon even when the spoon is turned over.

In foams produced by the process of this invention, pore size is smaller and more uniform. Moreover, the use of a viscosity-increasing agent makes it possible to use less foaming agent than would otherwise be required, the reduction in amount of foaming agent being greater than that provided by any expansion of the alloy due to the presence of the viscosity-increasing agent. For example, when carbon dioxide is used and $ZrH_2$ is the foaming agent, 0.6 gram of $ZrH_2$ will give the same expansion that 1.0 gram thereof provide in the absence of $CO_2$ pretreatment. This provides a considerable saving in the cost of foaming.

One can calculate how much gas is required to achieve a desired amount of foaming. The amount of gas is conveniently expressed in theories, and one theory is the amount of gas which would be generated (if the foaming agent completely decomposed) to produce a known void volume in a mass (conveniently expressed in pounds per cubic foot density or g/cc of foam). For 15 pounds per cubic foot density, 2.5 to 3.0 theories of $TiH_2$ are required and this is equivalent to 0.8 to 1.0 gram $TiH_2$ per 1000 grams of metal. However, after $CO_2$ treatment, to make an equivalent foam, only 1.2 to 1.7 theories or 0.4 to 0.6 gram of $TiH_2$ are required.

When the foamed metal is thickened, the fibers can then be dispersed into the thickened material. When adding the inorganic fiber reinforcing material to the thickened molten metal the fibers should be substantially uniformly adequately dispersed into the molten metal. However, the addition of the fibers to the thickened molten metal should not consume so much time that the temperature of the melt is unduly decreased or the melt begins to "thin" or the fiber material is damaged by the mixer or the relatively high temperatures of the molten metal. The inorganic fibers may be admixed into the thickened molten metal by high speed stirring means known to those skilled in the art. It is not sufficient to merely add the inorganic fibers to the top of the molten melt since this results in insufficient incorporation of the fiber into the final foamed product with resulting variations in strength of the reinforced foam. Further, it is not a requirement of this invention that the mixing or stirring be carried out to such a point that the fibers are entirely uniformly distributed throughout the thickened molten metal. Variations in the amount of fiber dispersed throughout the final foamed metal body are possible without unduly decreasing the strengthening effect of the fibers. However, it is a preferred embodiment of this invention to have the fibers substantially uniformly and randomly dispersed throughout the molten metal.

When the fiber is added prior to thickening by high speed stirring, the molten metal is considerably more fluid and requires less energy to stir. However, the fibers tend to float on the top of the melt and separate from the melt. By using high speed stirring the fibers are quickly incorporated into the melt and wetted by the molten metal. Thus, the fiber-containing melt is ready for thickening and/or foaming without substantial temperature loss and before substantial damage can be done to the fibers.

By high-speed stirring is meant speeds greater than 1000 rpm and preferably from about 1200 to about 10,000 rpm. Usually the stirrer will proceed from the lower end of the range to the higher end during incorporation of fibers into the molten metal or thickened melt. This can be accomplished easily with a variable speed motor and avoids inefficient operation or splashing of the molten metal.

The high speed stirring is accomplished rather quickly, depending on the size of the batch. Usually, the thickened melt requires a longer stirring time to incorporate the fibers into the melt. In general, less than one minute is required to disperse the fibers sufficiently. Factors influencing the time range from the composition of the alloy, type of fiber, viscosity of the melt, the speed of the mixer and the like. To avoid cooling the melt and damaging the fibers the stirring should be kept to a minimum, preferably less than 30 seconds and more preferably from about 10 to about 20 seconds.

In addition, the fibers may also be incorporated into the molten metal during the thickening process or during the foaming step. Moreover, if sufficient control of the foaming molten metal mass can be maintained, one can incorporate the strengthening fibers after the metal was foamed and prior to cooling the temperature of the foaming mass to set the foam. A skilled practitioner can vary the point in the process at which the fiber is incorporated into the metal melt according to the type of fiber, the type of metal to be foamed, the time and type of foaming and thickening, and the stability of the foam produced to produce a fiber reinforced foam within the scope of this invention.

The process for preparation of fiber reinforced metal foam is more fully illustrated in the following examples. For purposes of illustration a general procedure for preparing foamed aluminum without reinforcing fibers is first described in the following example.

EXAMPLE 1

General Procedure for Preparing Foamed Aluminum Without Fiber Reinforcing

A sample of a magnesium-aluminum alloy having 7 weight percent of magnesium and 0.2 weight percent of Mn weighing 3173 grams was melted. Nitrogen gas, at a flow rate of 8 liters per minute, was bubbled through the molten alloy for five minutes. The nitrogen was admitted into the molten alloy through a ceramic tube about two inches below the surface. The alloy was stirred at about 2500 rpm during the nitrogen introduction. Stirring was commenced when the alloy was at 670°C, and at the end of nitrogen introduction the temperature was 550°C.

The alloy was heated to 725°C and transferred to a holding furnace. The increase in viscosity noted at the end of the five-minute introduction period was still apparent upon reaching 725°C. The alloy (prior to nitrogen introduction) had a true viscosity of about 13.8 cp and, upon reaching 725°C, the viscosity was about 29 cp. However, the alloy was very resistant to flow.

The above procedure was repeated using a second batch of the alloy weighing 3185 grams. The nitrogen flow rate was 7 liters per minute and the nitrogen introduction time was 5.4 minutes.

The two batches were combined in a pot heated to 670°C. The metal mass was allowed to cool to 680°C. The mass was stirred at 6000 to 10,000 rpm and 40 grams of zirconium hydride, $ZrH_2$, was admixed over an introduction period of 8.6 seconds. Thereafter, it was cast into a mold. The mold capacity was about 8 to 9 times as big as the volume of the unblown liquid combined batches.

The mixture foamed to fill the (closed) mold. The resultant foam was sectioned demonstrating a fine pore, quite uniform structure having a density of about 25 pounds per cubic foot (a density of about 15 percent of unfoamed alloy).

Similar results are obtained when the viscosity-increasing agent is carbon dioxide, air, oxygen, or an inert gas. Also, the foaming agent can be titanium hydride or hafnium hydride.

The following example utilizes a generally similar procedure and illustrates the process of this invention and the articles produced thereby.

EXAMPLE 2

A magnesium-aluminum alloy weighing 14,074 grams and having 7 weight percent of magnesium and one weight percent of titanium was melted into a suitable pot by an induction furnace. To the molten metal was added 785 grams of fiberglass. The melt was stirred with high speed stirring to disperse the fibers which were about 1 inch in length. Reheating was frequently necessary to maintain the melt temperature at about 790°C. The addition of the fiberglass fibers caused the melt to thicken. Additional thickening was achieved by adding 800 grams of $CO_2$ as a solid to the melt pot with efficient stirring.

The thickened melt was transferred to a foaming pot and reheated to a temperature of 670°C. Then 94 grams of zirconium hydride were added and quickly dispersed into the melt by stirring with a high-speed stirrer, up to about 8200 rpm, for about 12 seconds. The foaming melt was cast into a mold measuring 26 × 26 × 3⅝ inches. Approximately 98 percent of the foaming melt was transferred to the mold and the foaming metal filled about 90 percent of the mold.

On cooling the foamed aluminum slab appeared to have a fair foam quality with medium to fine pores. The foamed aluminum contained about 5 weight percent fiberglass.

Similar results are obtained when the thickening agent is nitrogen, oxygen, air, water, or an inert gas. Also, the zirconium hydride foaming agent can be replaced by titanium hydride or hafnium hydride. The aluminum alloy can be replaced by other alloys of aluminum; such as, a magnesium alloy from 2 to 10 percent by weight of magnesium, 0.5 to 2.5 percent titanium, 2.5 to 35 percent copper, from 3 to 15 percent zinc, 0.4 to 1.5 percent magnesium, 0.4 to 2 percent tin, 0.2 to 4 percent zirconium, and further aluminum alloys. Moreover, preferred aluminum alloys can be any commercially available aluminum. Typical of the commercially available aluminum metal preparations are aluminum Alloy-3S (98 percent aluminum, 1.25 percent magnesium) and Aluminum 2S (99.2 percent aluminum). A most preferred aluminum alloy is Almag 35 which is a magnesium alloy having 6 to 8 percent magnesium. Further, similar results can be obtained when the aluminized fiberglass is substituted with aluminized chopped fiberglass mat or plain fiberglass chopped fibers up to about 2 inches in length.

The following examples are illustrative of the different types of fibers which may be included in the foamed aluminum.

EXAMPLE 3

Following a procedure similar to Example 2, about 750 grams of chopped fiberglass mat was dispersed by high speed stirring into a melt consisting of an aluminum-magnesium alloy (7 percent magnesium) with 1 percent by weight of titanium of about 13,620 grams. The melt was further thickened by adding 800 grams of solid $CO_2$ and the thickened melt was transferred to a foaming pot. The temperature in the foaming pot was maintained at about 660°C and 94 grams of zirconium hydride was added by high speed stirring for about 12 seconds. The foaming mass was cast but only about 50 to 60 percent of the mold was filled.

EXAMPLE 4

A charge of 1650 grams of Almag 35 plus one percent titanium alloy was melted at about 790°C. To the melt was added 397.25 grams of aluminized fiberglass which was dispersed into the melt with high speed stirring. The aluminized fiberglass is fiberglass coated with aluminum. To the melt was then added 80 grams of $CO_2$ with efficient stirring. The fibers were added to the melt at a temperature of 750° to 760°C, and the additional $CO_2$ thickening was carried out at a melt temperature of 760°C. The melt had a consistency of whipped cream. After transferring to the foaming pot, 9.4 grams of zirconium hydride was added to the melt over a period of 21 seconds with high speed stirring. On completion of hydride addition, the melt was cooled and the foam filled only about ¾ of the foaming pot. The foam removed from the pot was a fair quality foam containing 25 percent weight of aluminized fiberglass.

EXAMPLE 5

Following the procedure of Example 2, a charge of 20,251 grams of Almag 35 plus one percent titanium alloy was melted at about 790°C, and to the melt was added 1500 grams of a kaolin mineral wood material commercially available from Babcock and Wilcox under the trade name "Kaowool." The "Kaowool" was stirred into the melt by high speed stirring and then 121.5 grams of $CO_2$ were added to the melt. The melt was transferred to the foaming pot, and 94 grams of zirconium hydride was added thereto with high speed stirring for about 12 seconds. The melt temperature was about 670°C. The melt began to foam and was transferred to a mold measuring 26 × 26 × 3⅝ inches. About 60 percent of the charge was transferred, and this amount of material filled approximately 50 percent of the mold. A foamed aluminum slab containing 10 percent "Kaowool" fibers was produced.

Similar results may be obtained when the "Kaowool" is replaced by any mineral fiber; for example, asbestos, kaolin, and the like. Further, the inorganic refractory fibers may also be used to replace the "Kaowool"; such as, potassium titanate, silicon carbide, boron nitride, titanium carbide, titanium dioxide, graphite, alumina, aluminum-coated graphite, and the like. These fibers may be used in from 1 to about 25 percent by weight based on the weight of the metal foam.

EXAMPLE 6

Following the procedure outlined in Example 2, a charge of about 13,393 grams of Almag 35 was melted at a temperature of 790°C. To the charge was added 5 weight percent chromel fibers or about 772 grams. The charge was thickened with $CO_2$ using about 467 grams in solid form. The fiber addition and thickening were carried out at about 790°C using high speed stirring. A portion of the charge was lost while thickening and stirring in the fibers. The molten metal was transferred to a foaming pot where 94 grams of zirconium hydride was added to the charge at about 670°C with high speed stirring for about 12 seconds. The foaming metal was transferred to a mold measuring 26 × 26 × 3⅝ inches and allowed to foam. The foam was cooled and set forming a slab having a deep depression in the top since either this portion did not fill in or the foam collapsed prior to cooling.

The foam produced is of fair quality and contains about 5 percent chromel fibers.

Similar results are obtainable when the reinforcing fiber is iron, steel, nickel, titanium or alloys of these metals. In addition, the reinforcing fiber may be nickel-plated iron or nickel-plated steel or copper fibers and aluminum-plated versions of these fibers or alloys thereof.

The reinforcing effect of the inclusion of fibers into foamed metals can be seen from the result of flexural test data obtained in comparison with unreinforced foams. The test procedure involved is the use of a sample of foam measuring about 2½ × 12 × ¾ inches. The test foams are set up on cyclindrical 1 inch bars over a 10 inch span with the supports being parallel to the 2½ inch dimension and approximately 1 inch from the end of the test sample. Thus, providing a unsupported span of about 10 inches. The unsupported span was then incrementally loaded uniformly across its midpoint by means of a flat beam 1 inch wide driven by an Instron tester at a speed of about 2½ inches per hour. The load required to deflect the test sample 0.15 inches, the load at test sample failure and the deflection in inches at failure were recorded. Data is presented in the following table.

TABLE 1

| Test | Foamed Metal | Type | Amount, % | Flexural Strength Test Data* Density, lbs per cubic ft | Load to Deflect 0.15 in. | Failure* Load, lbs. | Deflection at Failure, inches | Strength to Weight Ratio |
|---|---|---|---|---|---|---|---|---|
| 1 | Almag 35 | — | — | 13 | — | 20 | — | 1.5 |
| | | | | | — | 28 | — | 2.16 |
| 2 | Almag 35 | — | — | 15 | — | 29 | — | 2.00 |
| | | | | | — | 40 | — | 2.66 |
| 3 | Almag 35+ 1 Wt. % Ti | Aluminized Fiberglass | 10 | 13.1 | 45 | 45 | 0.15 | 3.4 |
| | | | | 14.1 | 50 | 58 | 0.22 | 4.1 |
| 4 | Almag 35+ 1 Wt. % Ti | Alumina-Silica Kaowool | 10 | 17.4 | — | 48 | 0.135 | 2.76 |
| | | | | 17.5 | 57 | 70 | 0.24 | 4.30 |
| | | | | 18.0 | — | 57 | 0.14 | 3.16 |
| 5 | Almag 35+ 1 Wt. % Ti | Chromel | 5 | 15.4 | 42 | 44 | 0.135 | 2.8 |
| | | | | 17.3 | 55 | 57 | 0.185 | 2.9 |

*Test sample 2½" × 12" × ¾"
-- 10" on centers --

The data illustrate that higher load values are obtained by the reinforced samples. An interesting comparison of the samples is made by dividing the failure load by the density of the particular foam sample to provide a value known as the strength-to-weight ratio. Such a comparison allows one to correlate the strength of various densities of foamed metals. This value is fairly consistent for foams having densities between 12 and 20 pounds per cubic foot. It is significant that the strength-to-weight ratio of the reinforced metal foams is greater than for the unreinforced foams. Particularly, the fiberglass reinforced foams show significant increases in the strength-to-weight ratios.

Metal foams other than aluminum are useful in producing fiber reinforced foams. Metals, such as zinc, lead, nickel, copper, steel, and the like are all suitable for foaming and reinforcing according to the process and articles of this invention. The following examples illustrate the preparation of zinc foams (Examples 7–9 and 11) and reinforced zinc foams (Examples 10 and 12) according to this invention.

EXAMPLE 7

In a cylindrical reaction vessel, a 1200 gram charge of substantially pure zinc was heated to 440°C. To this was added 4 grams of $TiH_2$ enclosed within lead foil. The addition of titanium hydride was carried out while dispersing, using high speed mixing, for approximately 30 seconds. Very slight foaming occurred. An additional 5-gram portion of titanium hydride was added and stirred in for approximately 30 seconds while the molten metal was at a temperature of 470°C, utilizing an induction field. While this temperature was maintained, foaming continued for 4–5 minutes. Upon cooling, a good quality foam of 12–13 percent density with very small (1/64–1/32 inch) average pore size cells was produced.

Similar foams are made when the amount of titanium hydride is from 1 to 15 grams per 1000-gram portion of zinc. Similar foams are also produced when the same amounts of magnesium hydride are employed but in general they have larger pores than analogous $TiH_2$ foamed materials. Likewise, analogous foams are produced from zinc alloys having up to about 15 weight percent of alloying material selected from magnesium, aluminum, zinc, and combinations thereof. Similar foams are produced when the process of the above invention is continued at temperatures up to about 625°C. However, the foaming is more rapid and in many instances, greater amounts of blowing agent are preferably employed.

Our work has indicated that zinc foams are made in fine pore qualities only if they have been subjected to at least two foam operations. If only one expansion is allowed to take place, the resultant foam will be large celled, non-uniform, and will usually have a heavy skin bottom. Such inferior foams can be produced for example, using pure zinc and 0.75 – 1.25 grams of titanium hydride per each 100-gram portion of zinc employed.

EXAMPLE 8

To a cylindrical mixing vessel was added 7,425 grams of pure zinc. The temperature of the vessel was increased until the zinc melted at about 242°C. The temperature of the melt was increased to about 550°C. After heating, 145 grams of titanium powder (100–200 mesh) was stirred into the melt at about 550°C. The metal was transferred to a mixing pot equipped with a bottom drop for casting in a mold. The temperature of the metal at transfer was 525°C. About 56 grams of titanium hydride in 5 aluminum foil packets was added to the melt with efficient stirring for about 10 to 20 seconds using a high speed stirrer. The temperature of the melt after addition of titanium hydride was between 500° and 510°C. The melt became so thick that the stirrer motor could not stir it. The bottom was dropped from the mixing vessel and the metal cast into a 15 × 15 × 4½ inch mold lined with ¾ inch thick porous silica brick. Considerable zinc did not transfer. The melt began to foam in the mold but did not fill the corners. The cooled and set foam weighed about 3,960 grams. After cooling the foam was sectioned revealing a fine pore foam.

EXAMPLE 9

Following the procedure of Example 8, a charge of pure zinc weighing 7,410 grams was melted and 145 grams of titanium powder was stirred into the melt. The melt was transferred to a mixing pot containing a bottom drop at about 520°C. About 40 grams of titanium hydride in 5 aluminum foil packs was added to the melt at about 520°C. The titanium hydride was stirred into the melt for about 20 seconds using a high speed stirrer. The mixture was transferred to the mold through the bottom drop with the stirrer still running but did not flow readily. Approximately 60 to 70 percent of the mold bottom was covered initially. A marinite lid was placed on top of the mold; and as the zinc foamed, it filled the entire mold and raised the lid. The cooled and set foam weighed 5,160 grams. On sectioning it was observed to be a uniform quality foam having pores about ⅛ to 1/16 inch in diameter.

EXAMPLE 10

To an inductively heated crucible was added 11.62 kilograms of substantially pure zinc balls. The metal was melted by heating to 550°C. About 75 grams of alumina ($Al_2O_3$) were added while dispersing, using high speed stirring, to thicken the molten zinc. The melt was then transferred to a casting unit which was a 6-inch diameter cylindrical cast iron mixing pot having a hinged bottom through which the melt can be cast into a mold. The mixing pot was preheated to about 600°C. At 510°C, 200 grams of titanium hydride, grade E, from Ventrol Chemical Co., enclosed in 10 aluminum foil packets was added to the melt with stirring. The zinc foamed in the crucible and was transferred to a mold heated to about 385°C. The foaming zinc was cast into the mold and continued to foam slightly during cooling. The foamed zinc was of poor quality being only about 2 inches high and having a very heavy bottom layer.

The set foamed zinc was removed from the mold and broken into manageable pieces. About 9 kilograms of this were placed into another crucible and heated to about 460°C. On melting, the stirrer was placed in the melt and stirred at high speed for about 30 seconds. The molten metal began foaming. At this point about 40 grams of aluminized fiberglass in strands about 0.001 inch in diameter and 0.625 inch long was mixed into the melt while dispersing using the high speed stirrer. The melt was allowed to stand for several minutes and became very thick. The metal was heated to about 530°C, restirred and it remained viscous, though it appeared to be not quite as thick as before.

At 530°C the melt was transferred to another crucible heated to 565°C. The second crucible having a bottom drop was positioned so that upon foaming the melt could be dumped into a 15 × 15 × 4½ inch mold heated to about 375°C. When the melt reached about 505°C, about 150 grams of titanium hydride enclosed in 20 aluminum foil packs were added to the melt and dispersed with high speed mixing for about 15 seconds. When the metal began to foam in the crucible, the stirrer was shut off and removed. The foaming molten mass was transferred to the mold. About 10 percent of the metal did not transfer. The metal foamed above the mold height but did not fill the corners.

Sectioning revealed large pores, a dark color, the presence of fiberglass, and a thin bottom skin.

EXAMPLE 11

In a cylindrical reaction vessel were melted 1,091 grams of ILZRO Alloy Number 12 (11-13 percent aluminum, 0.15 – 1.25 percent copper, 0.01 – 0.03 percent magnesium, and balance zinc). The temperature was raised to 720°C. One hundred seventy grams of solid carbon dioxide (dry ice) were mixed into the metal. The temperature dropped to 550°C after mixing. No marked viscosity improvement was noted.

The temperature of the melt was raised to 680°C; and before the hydride blowing agent could be added, it was noted that some foaming occurred and the metal became extremely thick. At 680°C, 10 grams of zirconium hydride was stirred into the melt. The stirrer was removed and the molten zinc began to foam rapidly. When the foam was cooled and set, a good quality foam with a ½ inch solid bottom was produced.

EXAMPLE 12

This example illustrates the reinforcement of ILZRO Zinc Alloy Number 12 with fiberglass. A charge of 1,010 grams of Alloy Number 12 was melted in a reaction vessel and the temperature raised to 550°C. Twenty grams of aluminized fiberglass strands averaging about ⅝ inch in length and being 0.001 inch in diameter were stirred into the melt with the high speed stirrer. The temperature decreased to about 520° and the metal was reheated to 650°C. About 10 grams of zirconium hydride contained in an aluminum foil packet was stirred into the melt. Severe flaming and smoking accompanied stirring the hydride into the melt. After 90 seconds high speed stirring, the stirrer was removed and the metal foamed rapidly almost to the top of the reaction vessel. On cooling the foam began to shrink. The set zinc foam reinforced with fiberglass was of medium quality with a thick bottom skin.

Similar results may be obtained when the aluminized fiberglass is replaced with any suitable metal, mineral, or refractory fiber. Typical fibers are potassium titanate, silicon carbide, boron nitride, graphite, asbestos, kaolin, iron, steel, nickel, copper, titanium, magnesium and the like. Similar reinforcement of zinc foams can be obtained with aluminized fiberglass or any of the hereinabove-mentioned fibers when the substantially pure zinc is replaced with a suitable alloy of zinc such as ZDC No. 3 (AG40A), ZDC No. 5 (AC41A), and Alloy ZDC No. 7. Compositions of such alloys are set forth on pages 28-9 of *ASARCO, Zinc Die Casting Alloys*, American Smelting and Refining Company Bulletin VI-1. The compositions of those alloys recited on the cited pages are incorporated herein by reference as if fully set forth. Another typical alloy is ILZRO 12, having the following composition:

| | |
|---|---|
| Aluminum | 11–13 percent |
| Copper | 0.15–1.25 percent |
| Magnesium | 0.01–0.03 percent |
| Zinc | balance |

Also lead-zinc alloys can be used as the foaming metal and reinforced by this invention.

The reinforced zinc foams have improved properties resulting from the inclusion of fibers. The strength of the fiber-reinforced zinc foams is considerably increased because of the fiberglass. The advantageous properties are readily apparent from the following compressive strength data comparing unreinforced zinc foam with zinc foam having 0.4 weight percent of aluminized fiberglass added thereto. The compressive strength was determined using a 1-inch cube of foamed zinc. The test sample is set on an Instron tester and incrementally loaded with the crosshead set at a speed of about 0.2 inch per minute. The maximum load required to crush the foam sample is recorded.

The data illustrate that higher compressive strengths for a given density sample are obtained with reinforced zinc foam samples resulting in higher strength-to-weight ratios. For the pure zinc foams the use of 0.4 weight percent of aluminized fiberglass reinforcing fibers provides almost double the strength-to-weight ratio. This is especially important in the lower density foams so that increased strength without a large increase in weight is obtained.

Reinforced metal foams can be used in any application that the metal foams themselves can be employed. However, they have the advantage of a greater safety factor in load bearing properties because of the higher strength-to-weight ratios. Reinforced metal foams can be used as structural materials especially where it is advantageous to have light metal construction in trailer walls, doors and floors, aircraft decking, sandwich wall constructions, curtain walls, etc.

In addition to the foregoing applications, fiber material can be used in metal foams to enhance other properties and for other reasons. Without limiting the invention, the hereinabove described fibers can be used to extend the metal foams. Thus, a given weight of metal can be extended to a greater volume when fiber material is incorporated therein. Further, when metal fibers, such as steel or iron, are incorporated in non-magnetic foamed metals, the magnetic properties of foamed metals are enhanced. One skilled in the art can envision further uses for fiber-containing metal foams within the spirit of this invention.

The foregoing description and disclosure are exemplary and illustrative of the invention. One skilled in the art will recognize a number of variations which can be made in the invention without departing from the spirit of the invention.

What is claimed is:

1. A process for producing a fiber reinforced aluminum-based metal foam, said process comprising dispersing with high speed stirring from about 0.1 to about 25 weight percent, based on the weight of said metal foam, of fibers from about 125 to about 1000 mils in length and having a ratio of length to diameter greater than 50 into a molten metal to be foamed which is aluminum or an aluminum alloy; increasing the viscosity of said molten metal by incorporating therein a

COMPRESSIVE STRENGTH TEST DATA*

| Test No. | Foamed Metal | Reinforcement Type of Fiber | Reinforcement Amount | Foam Density lbs/ft³ | Compressive Strength lbs/in² | Strength to Weight Ratio lbs/in²/lbs/ft³ |
|---|---|---|---|---|---|---|
| 6 | 99.9% Zn | None | | 16.0 | 56 | 3.5 |
| 7 | 99.9% Zn | None | | 17.1 | 56 | 3.3 |
| 8 | 99.9% Zn | None | | 27.2 | 109 | 4.0 |
| 9 | 99.9% Zn | None | | 45.5 | 340 | 7.5 |
| 10 | 99.9% Zn | Aluminized Fiberglass | 0.4 | 16.0 | 118 | 7.4 |
| 11 | 99.9% Zn | Aluminized Fiberglass | 0.4 | 17.4 | 125 | 7.2 |
| 12 | 99.9% Zn | Aluminized Fiberglass | 0.4 | 27.7 | 270 | 9.7 |
| 13 | 99.9% Zn | Aluminized Fiberglass | 0.4 | 45.5 | 448 | 9.9 |
| 14 | Alloy 12 | None | | 17.5 | 430 | 24.6 |
| 15 | Alloy 12 | None | | 23.6 | 785 | 33.3 |
| 16 | Alloy 12 | None | | 33.1 | 1050 | 31.1 |
| 17 | Alloy 12 | Aluminized Fiberglass | 0.4 | 17.3 | 567 | 33.1 |
| 18 | Alloy 12 | Aluminized Fiberglass | 0.4 | 25.7 | 1150 | 44.8 |
| 19 | Alloy 12 | Aluminized Fiberglass | 0.4 | 35.7 | 1420 | 41.0 |

*Test sample 1" × 1" × 1"

viscosity-increasing agent selected from the group consisting of air, carbon dioxide, nitrogen, oxygen, water and the inert gases at a temperature of from about 20° to about 90°C above the liquidous point of said molten metal; foaming said molten metal by treating the thickened molten metal with a foaming agent which is a metal hydride selected from the group consisting of titanium hydride, zirconium hydride and hafnium hydride; and cooling the foamed metal to set said foam.

2. A process of claim 1 wherein said fibers are inorganic fibers.

3. A process of claim 2 wherein said inorganic fibers are selected from the group consisting of fiberglass, metallized fiberglass, mineral fibers, refractory fibers and metal fibers.

4. A process of claim 1 wherein said fibers are fiberglass.

5. A process of claim 1 wherein said fibers are metallized fiberglass, said metallized fiberglass being coated with a metal selected from the group consisting of aluminum, zinc and alloys of these metals.

6. A process of claim 1 wherein said fibers are refractory fibers selected from the group consisting of potassium titanate, silicon carbon, alumina, boron nitride, titanium carbide, titanium dioxide, and these fibers when coated with a metal selected from aluminum, zinc, and alloys of these metals.

7. A process of claim 1 wherein said fibers are metal fibers selected from the group consisting of iron, steel, nickel, titanium, alloys of these metals, nickel-plated iron, nickel-plated steel, nickel-plated copper and aluminum-plated steel.

8. A process of claim 1 wherein said fibers are mineral fibers selected from the group consisting of asbestos, kaolin, alumina-silica, alumina-magnesia and alumina-magnesia-silica.

9. A process of claim 1 further characterized in that the viscosity of the molten metal to be foamed is increased by incorporating therein a viscosity-increasing agent selected from the group consisting of air, carbon dioxide, nitrogen, oxygen, water and the inert gases, and then dispersing said fibers into the thickened molten metal, foaming the molten metal and cooling the foaming molten metal to set the foam producing a reinforced foamed metal article.

10. A process of claim 1 wherein said molten metal is an aluminum alloy having from 6 to 8 percent magnesium.

11. A process of claim 1 wherein said fibers are fiberglass in the form of chopped filament, said fiberglass being present in an amount of from about 1 to 25 percent by weight based on the weight of the molten aluminum alloy.

12. A process of claim 1 wherein said metal foam is a zinc-based foam and said molten metal is a zinc alloy having about 11-13 weight percent aluminum.

13. A process of claim 12 wherein said fibers are metallized fiberglass.

14. A process of claim 12 wherein said fibers are aluminized fiberglass in an amount of from about 0.1 to about 10 weight percent.

* * * * *

UNITED STATES PATENT OFFICE
CERTIFICATE OF CORRECTION

PATENT NO. : 3,940,262
DATED : February 24, 1976
INVENTOR(S) : L. M. Niebylski et al It is certified that error appears in the above-identified patent and that said Letters Patent are hereby corrected as shown below:

Col. 15, line 25, reads "carbon", should read -- carbide --.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*